US012072159B2

(12) United States Patent
Wragg et al.

(10) Patent No.: US 12,072,159 B2
(45) Date of Patent: Aug. 27, 2024

(54) MUZZLE ATTACHMENT DEVICE

(71) Applicant: THOR INDUSTRIES LTD, Teffont (GB)

(72) Inventors: Alistair Wragg, Salisbury (GB); Lee Thornhill, Salisbury (GB)

(73) Assignee: THOR INDUSTRIES LTD, Teffont (GB)

( * ) Notice: Subject to any disclaimer, the term of this patent is extended or adjusted under 35 U.S.C. 154(b) by 118 days.

(21) Appl. No.: 18/061,003

(22) Filed: Dec. 2, 2022

(65) Prior Publication Data

US 2023/0175803 A1 Jun. 8, 2023

(30) Foreign Application Priority Data

Dec. 7, 2021 (GB) ..... 2117620

(51) Int. Cl.
*F41A 21/32* (2006.01)

(52) U.S. Cl.
CPC ..... *F41A 21/325* (2013.01)

(58) Field of Classification Search
CPC ..... F41A 21/32; F41A 21/325; F41A 21/34; F41A 21/36; F41A 21/38
USPC ..... 89/14.1, 14.2, 14.3, 14.05
See application file for complete search history.

(56) References Cited

U.S. PATENT DOCUMENTS

| | | | | |
|---|---|---|---|---|
| 3,698,747 | A * | 10/1972 | Wing | F16L 37/144 285/305 |
| 5,698,810 | A * | 12/1997 | Rose | F41A 21/32 89/14.3 |
| 6,948,415 | B2 | 9/2005 | Matthews et al. | |
| 7,353,740 | B1 * | 4/2008 | Hoffman | F41A 21/325 89/14.05 |
| 8,201,487 | B2 * | 6/2012 | Dueck | F41A 21/325 89/14.05 |
| 9,182,187 | B1 * | 11/2015 | Griffith | F41A 21/325 |
| 9,658,019 | B2 * | 5/2017 | Smith | F41A 21/30 |
| 9,709,355 | B2 | 7/2017 | Joplin et al. | |
| 10,161,704 | B1 * | 12/2018 | Lee | F41A 21/325 |
| 2013/0180797 | A1 | 7/2013 | Dueck | |
| 2018/0017352 | A1 * | 1/2018 | Addis | F41A 21/36 |
| 2021/0404760 | A1 | 12/2021 | Hipp | |
| 2023/0078533 | A1 * | 3/2023 | Risley | F41A 21/36 89/14.3 |

FOREIGN PATENT DOCUMENTS

WO 2019005601 A1 1/2019

* cited by examiner

*Primary Examiner* — John Cooper
(74) *Attorney, Agent, or Firm* — LORENZ & KOPF, LLP

(57) ABSTRACT

Disclosed herein is an attachment device for use with a firearm. The attachment device has a central axis and includes an annular body having first and second ends and an external surface. A first connector, for connecting to a muzzle attachment, is located proximate to the first end. The first connector allows for axial movement of the muzzle attachment but prevents radial movement of the connected muzzle attachment. A second connector is located proximate to the second end. The second connector connects the attachment device to the firearm.

17 Claims, 4 Drawing Sheets

MUZZLE ATTACHMENT DEVICE

CROSS REFERENCE TO RELATED APPLICATION

This application claims priority to United Kingdom Patent Application No. 2117620.1, filed Dec. 7, 2021, the entire content of which is incorporated by reference herein.

TECHNICAL FIELD

Embodiments of the subject matter described herein relate generally to muzzle attachment devices for use with firearm barrels. More particularly, embodiments of the subject matter described herein relate to muzzle attachment devices which allow for tuning of the firearm.

BACKGROUND

Target, hunting or professional shooters may use a muzzle attached ancillary ("muzzle attachment") when shooting. Muzzle attachments allow for the modification of certain firearm characteristics. For example, muzzle attachments include sound moderators (to suppress the audible noise of the firearm); muzzle brakes (to reduce the recoil felt by the firer) and flash suppressors, amongst others.

Some muzzle attachments allow for user to 'time' the device onto the barrel of the firearm without requiring this to be done by a professional gunsmith. As used herein, the term 'timing' is defined as attaching the muzzle attachment to the firearm barrel in a particular orientation. 'Timing' a muzzle attachment onto the barrel of the firearm allows for proper operation of the muzzle attachment. For example, in the case of the muzzle attachment being a muzzle brake, the muzzle brake is designed to port gases to the horizontal sides of the brake (as opposed to above or below the brake). If the muzzle brake is not timed correctly to the firearm, the accuracy of the firearm may decrease. The same orientation issue may also be present with other types of muzzle attachment.

Furthermore, there are several different thread sizes common to muzzle attachments, which are not neatly correlated to caliber or manufacturer or even the region of manufacture—a single caliber firearm can have multiple common thread sizes. Further to this, there can be a large variation in the external profile of a barrel, again even for the same caliber.

Additionally, there exist devices that 'tune' the firearm through micro adjustments to a heavy mass at the muzzle end, which devices are generally known as barrel tuners. Tuning is a useful tool for users, particularly those users who don't load their own ammunition and so generally use factory ammunition (most common for rimfire). This is because factory ammunition can have a variation in the propellant loading and this can have an effect on the barrel harmonics and thus effect group size/accuracy of shot placement. It is known that barrel vibration is a large contributor to firearm inaccuracy. Barrel temperature can also affect barrel harmonics and tuners can also help to cope with this variation of harmonics too.

'Tuning' of a firearm using a barrel tuner has been proven as a way to allow the user to on-demand adjust the barrel harmonics and improve their shooting group size.

The advantages associated with muzzle attachments and barrel tuners means that many users must have multiple different devices and muzzle attachments (sometimes even the same device but with different thread sizes) to fit the weapons that they own. The multiple different devices used on the firearm can be expensive, increase the overall weight of the firearm and also require lengthy shooting adjustment sessions to calibrate the different devices so as to achieve a desired level of accuracy for a particular weapon.

Accordingly, it is desirable to overcome the above disadvantages associated with the use of multiple different devices (such as a barrel tuner and a muzzle attachment). Furthermore, other desirable features and characteristics will become apparent from the subsequent detailed description and the appended claims, taken in conjunction with the accompanying drawings and the foregoing technical field and background.

BRIEF SUMMARY

According to a first aspect of the invention, there is provided an attachment device for use with a firearm barrel, the attachment device having a central axis and comprising: an annular body extending around the central axis and having a first end, a second end opposite to the first end and an external surface, wherein the annular body comprises a first connector located proximate to the first end of the annular body, the first connector for connecting a muzzle attachment to the attachment device, wherein the first connector allows for axial movement of the connected muzzle attachment parallel to the central axis but prevents rotational movement of the connected muzzle attachment about the central axis; and a second connector located proximate to the second end of the annular body, the second connector for connecting the attachment device to the firearm barrel.

In an embodiment, the attachment device is both partially and fully connectable to the firearm barrel, wherein the attachment device is rotatable about the central axis when the attachment device is partially connected to the firearm barrel, and wherein the position of the first connector allows for visual timing of the attachment device with respect to the firearm barrel. Use of the first connector for visual timing of the device instead of using another device or mark on the attachment device allows for the construction of the attachment device to be made simpler and less expensive and also omits the need for any extra weight to be added to the attachment device to achieve this self-timing function.

In an embodiment, the first connector comprises a channel formed in the external surface of the annular body, the channel extending from the first end of the annular body. Use of a channel is a simple and robust way to achieve the prevention of rotational movement of the muzzle attachment whilst still allowing for axial movement of the muzzle attachment. Furthermore, if only a single channel is used, the amount of residue introduced into the channel is reduced, thereby advantageously increasing the service time of the attachment device before maintenance is required.

In an embodiment, the attachment device comprises an adjustment screw thread disposed about the first connector.

In an embodiment, the second connector comprises a connecting screw thread to connect the attachment device to the firearm barrel.

In an embodiment, the attachment device comprises a linking nut comprising threads, the linking nut configured to thread onto the connecting screw thread of the second connector and onto a screw thread of the firearm barrel to thereby connect the attachment device to the firearm barrel. Use of a linking nut allows for the secondary connector of a single thread size to be universally connected to different firearm barrels having different thread sizes and also reduces the amount of dirt ingress into the screw threads of the firearm barrel and second connector. Preferably, the linking nut does not extend over an exterior surface of the firearm barrel and abuts against the front of the firearm barrel. This allows for the linking nut to be operational on multiple different firearm barrels, irrespective of the exterior profile of the firearm barrel.

According to a second aspect of the invention, there is provided a system comprising: an attachment device for use with a firearm barrel and a muzzle attachment. The attachment device has a central axis and comprises an annular body extending around the central axis and having a first end, a second end opposite to the first end and an external surface. The annular body comprises a first connector located proximate to the first end, the first connector for connecting a muzzle attachment to the attachment device, wherein the first connector allows for axial movement of the muzzle attachment parallel to the central axis but prevents rotational movement of the muzzle attachment about the central axis, and a second connector located proximate to the second end of the annular body, the second connector for connecting the attachment device to the firearm barrel. The muzzle attachment comprises a muzzle connector configured to connect the muzzle attachment to the first connector of the annular body.

In an embodiment, the first connector of the annular body comprises a channel formed in the external surface of the annular body, the channel extending from the first end of the annular body, wherein the muzzle connector comprises a protrusion configured to slidingly engage with the channel so as to allow axial movement of the muzzle attachment parallel to the central axis and to prevent rotational movement of the muzzle attachment about the central axis. In this manner, the mass of the muzzle attachment may advantageously be used to tune the barrel instead of using a separate barrel tuning device.

In an embodiment, the muzzle attachment includes an adjustment mechanism, the adjustment mechanism comprising an adjustment wheel having an internal screw thread, wherein the attachment device includes an adjustment screw thread disposed about the first connector and configured to engage with the internal screw thread of the adjustment wheel, and wherein rotation of the adjustment wheel is configured to urge the muzzle attachment axially along the central axis. Use of an adjustment wheel in this manner allows for accurate barrel tuning using the mass of the muzzle attachment in an efficient, accurate and ergonomic manner.

In an embodiment, the attachment device further comprises a locking ring, the locking ring being releasingly engagable with the muzzle attachment and configured to, when engaged, prevent axial movement of the muzzle attachment along the central axis in a direction toward the second end of the annular body of the attachment device. With the locking ring, a user may store an axial position of the attachment device corresponding to optimum tuning of the firearm such that the attachment device may be removed and then reattached without another tuning process being required.

In an embodiment, the locking ring comprises a clamp configured to fix a position of the locking ring with respect to the annular body. Preferably, the clamp comprises a grub screw.

According to a third aspect of the invention, there is provided a method of attaching a muzzle attachment to a firearm barrel using an attachment device as described above. The method comprises the steps of partially connecting the attachment device to the firearm barrel using the second connector; rotating the attachment device about the central axis so that the first connector is positioned in a predetermined position so as to time the attachment device with respect to the firearm barrel; fully connecting the attachment device to the firearm barrel using the second connector; and connecting a muzzle attachment to the attachment device using the first connector. In an embodiment, the method further comprises adjusting the axial position of the muzzle attachment along the annular body during barrel tuning of the firearm According to a fourth aspect of the invention, there is provided a method of retrofitting a muzzle attachment device so as to be compatible with the above-described attachment device, the method comprising removing a part of the muzzle attachment device and replacing the part with a replacement part that includes a muzzle connector that is configured to connect with the first connector of the attachment device. For example, the method may comprises removing a rear plate of the muzzle attachment device and replacing the rear plate with a replacement rear plate that includes a muzzle connector that is configured to connect with the first connector of the attachment device. As another example, the method may comprises removing an annular body section of the muzzle attachment device and replacing the annular body section with a replacement annular body section that includes a muzzle connector that is configured to connect with the first connector of the attachment device.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
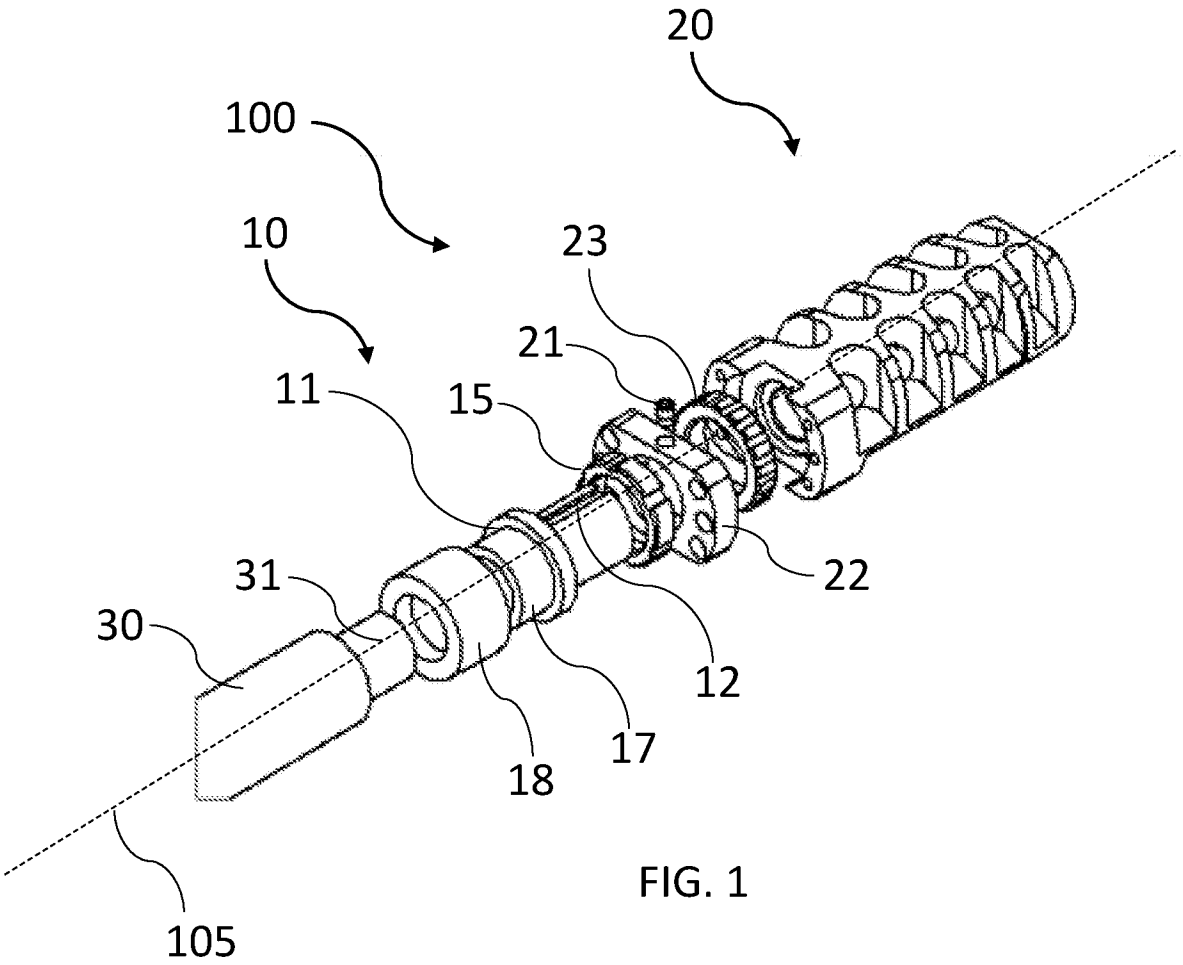
FIG. 1 shows an attachment device and muzzle attachment in accordance with a first embodiment of the invention.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

In addition, certain terminology may also be used in the following description for the purpose of reference only, and thus are not intended to be limiting. For example, terms such as "upper", "lower", "above", and "below" refer to directions in the drawings to which reference is made. Terms such as "front", "back", "rear", "side", "outboard", and "inboard" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

For the sake of brevity, conventional techniques related to the operation of firearms and other functional aspects of the systems (and the individual operating components of the systems) may not be described in detail herein. Furthermore, any connecting lines shown in the various figures contained herein are intended to represent exemplary functional relationships and/or physical couplings between the various elements. It should be noted that many alternative or additional functional relationships or physical connections may be present in an embodiment of the subject matter.

It should be appreciated that the below-described muzzle attachment device, and any corresponding elements, individually or in combination, are exemplary means for performing a claimed function.

When seeking to address the above-described problems associated with incorporating multiple devices onto a firearm, after an extensive period of research and development the present inventors realized that the muzzle attachment itself can be used to tune the firearm. Furthermore, this realization led the inventors to develop a system in which different muzzle attachments may be easily swapped on the firearm to thereby allow for easy customization of the firearm without the need for a professional gunsmith. Lastly, it was realized that the system also allowed for self-timing of a muzzle attachment and, once timed, any other muzzle replacements that were added to the firearm would already be timed to that particular firearm with no additional timing procedure being required for the new muzzle attachment. In other words, all of the above problems may be addressed with a single, easy-to-use system as will be described below.

FIG. 1 of the application shows a first embodiment of a system 100 including an attachment device 10 and a muzzle attachment 20. The attachment device 10 includes an annular body 11 which is disposed about a central axis 105. The annular body 11 may vary in radius along the length of the body, as will be made apparent from the figures of the application and the description provided hereafter. The central axis 105 is aligned with a central axis of a barrel 30 of a firearm. The attachment device 10 includes a first connector 12 that is positioned proximate to a first end of the annular body 11, and a second connector 17 that is positioned proximate to a second end of the annular body 11.

The second connector 17 is configured to directly or indirectly connect the attachment device 10 to the barrel 30 of the firearm. In the embodiment shown in FIG. 1, the second connector 17 comprises a screw thread disposed on an external surface of the second connector 17 that is configured to mate with internal screw threads of a linking nut 18, which is exemplified in the embodiment shown in FIG. 1 as a jam nut. The linking nut 18 connects to screw threads 31 disposed on an external surface of the barrel 30. Through the use of a jam nut 18, the amount of screw thread left visible between the barrel 30 and the attachment device 10 is reduced, thereby reducing the amount of dirt ingress into the screw threads 31 and thereby improving durability. In an alternative embodiment, the second connector 17 may include internal threads that connect directly to the external screw threads 31 of the barrel. In this alternative embodiment, the second connector 17 has a thread size chosen to be compatible with the screw threads 31 of the barrel 30. In an alternative embodiment, the linking nut 18 comprises an overnut, as will be described in more detail below. In further alternative embodiments, the second connector 17 comprises a clamp, such as a rotary clamp, which keeps the central axis 105 of the attachment device 10 aligned with the central axis of the barrel 30 when the attachment device 10 is connected to the barrel 30.

In various embodiments, the second connector 17 is capable of being partially tightened onto the barrel 30 and then fully tightened to fully connect the attachment device 10 to the barrel 30. When the second connector 17 is partially tightened onto the barrel 30, it is possible to rotate the attachment device 10 about the central axis 105 in order to time the attachment device 10 to the barrel 30, as will be explained in more detail below.

The first connector 12 is configured to connect the attachment device 10 to the muzzle attachment 20. The connection between the first connector 12 and the muzzle attachment 20 allows for axial movement of the muzzle attachment along the central axis 105 but prevents rotational movement of the muzzle attachment 20 about the central axis 105. In other words, once the muzzle attachment 20 is connected to the first connector 12, the muzzle attachment 20 may be forced to move axially forwards and backwards along the central axis 105 by means of an adjustment mechanism 23, which will be described below in more detail. However, the connected muzzle attachment 20 is prevented from rotating about the central axis 105 by the connection formed with the first connector 12.

In the embodiment shown in FIG. 1, the first connector 12 comprises a single channel. It was found by the inventors that the use of a single channel allowed for a robust connection which also reduces the amount of dirt ingress into the first connector 12 and thereby the attachment device 10, which increases the time required between maintenance procedures of the attachment device 10. In alternative embodiments, the first connector 12 comprises multiple channels. In other alternative embodiments, the first connector 12 comprises a non-circular shape of the annular body 11, such as a hexagonal shape. In further alternative embodiments, the first connector 12 comprises one or more holes disposed in the annular body 11 that are configured to co-operate with a connector on the muzzle attachment 20 to allow axial movement of the muzzle attachment 20 but prevents rotational movement of the muzzle attachment 20 about the central axis 105.

The muzzle attachment 20 includes a muzzle connector 21 configured to connect with the first connector 12 of the attachment device 10. In the embodiment shown in FIG. 1, the muzzle connector 21 comprises a screw, such as a dog-point screw, which protrudes from an internal surface of a rear plate 22 of the muzzle attachment 20. In FIG. 1, the protruding part of the screw is slidingly received within the channel 12 so as to allow axial movement of the muzzle attachment 20 along the central axis 105 and to prevent rotational movement of the muzzle attachment 20 about the central axis 105. In alternative embodiments, the muzzle connector 21 may include a pin, a grub screw, splines, or a corresponding shaped recess to a protrusion of the first connector 12. One of skill in the art will recognize, armed with the benefit of the present disclosure, that other connections are possible to achieve the function of allowing for axial movement of the muzzle attachment 20 along the central axis 105 whilst preventing rotational movement of the muzzle attachment about the central axis 105.

In order to cause the allowed axial movement of the muzzle attachment 20 along the central axis 105, an adjustment mechanism 23 is provided. In the embodiment shown in FIG. 1, the adjustment mechanism 23 comprises an adjustment wheel. The internal surface of the adjustment wheel includes screw threads which mate with adjustment screw threads disposed on an external surface of the annular body 11 proximate to the first end of the annular body 11. In an embodiment, the adjustment screw threads are positioned around the first connector 12.

As the adjustment wheel is turned by a user using a torsional force, the mating of the screw threads of the adjustment wheel and the adjustment screw threads convert this torsional force into an axial force, which urges the muzzle attachment 20 either forwards or backwards along the central axis 105. In a preferred embodiment, the screw threads disposed on the external surface of the annular body 11 which mate with the screw threads on the internal surface of the adjustment wheel are fine, so that small adjustments to the axial position of the muzzle attachment 20 may be made. In an embodiment, the screw threads are fine enough to make adjustments to the axial position of the muzzle attachment 20 on the order of fractions of a millimeter. In alternative embodiments, the adjustment mechanism 23 may comprise adjustable pins or a releasable clamp. One of skill in the art will recognize, armed with the benefit of the present disclosure, that other adjustment mechanism configurations are possible to achieve the above-stated function.

In an embodiment, the attachment device 10 may include a partitioning wall between the first connector 12 and the second connector 17. This partitioning wall may be disposed between screw threads of the second connector 17 and screw threads of the annular body 11 which mate with the internal threads of the adjustment wheel.

As shown in FIG. 1, the attachment device 10 may include a locking ring 15. The locking ring 15 is used to fixedly abut against the rear surface of the back plate 22 so as to prevent rearward axial movement of the muzzle attachment when the locking ring 15 is fixed in position. In the embodiment shown in FIG. 1, the locking ring 15 includes internal screw threads which mate with the external screw threads proximate the first end of the annular body 11. In other words, the locking ring 15 may mate with the same set of screw threads on the annular body 11 as the threads which mate with the adjustment wheel. In an embodiment, the locking ring 15 includes a clamp so as to retain the position of the locking ring on the annular body 11 without other components being present on the annular body. The clamp may be a grub screw or a pin. One of skill in the art will recognize, armed with the benefit of the present disclosure, that other connections are possible to achieve the function of retaining the locking ring 15 in position on the annular body 11.

Figure 2:
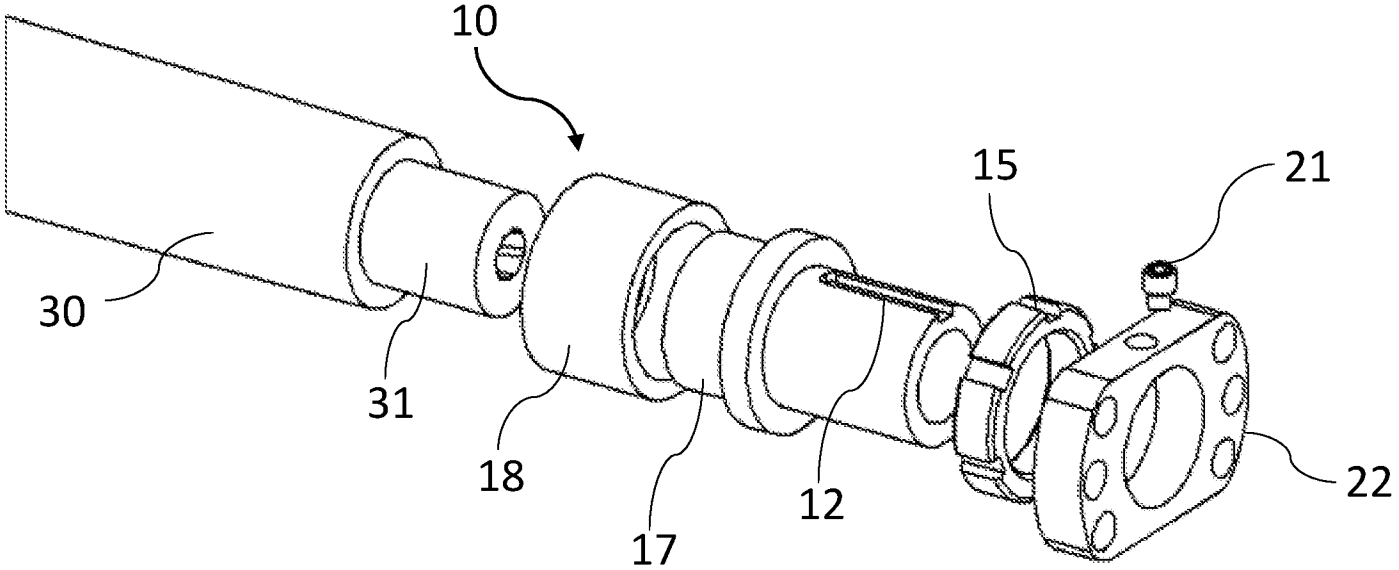
FIG. 2 shows an alternative view of the attachment device of FIG. 1.

Another view of the embodiment of FIG. 1 is shown in FIG. 2, with the majority of the muzzle attachment 20 removed. As can be seen in FIG. 2, the second connector 17 is configured to connect with the barrel 30 by means of the linking nut 18 mating with both screw threads 31 disposed on the barrel 30 and screw threads disposed on the second connector 17. The first connector 12 is configured to connect with the muzzle connector 21 which is included in the rear plate 22 of the muzzle attachment so as to prevent rotational movement of the muzzle attachment but to allow axial movement of the muzzle attachment. The locking ring 15 is configured to mate with screw threads disposed about the first connector 12 and is adjustable to fixedly abut up against the rear plate 22 so as to prevent rearward axial movement of the muzzle attachment, even when using the adjustment mechanism 23 to adjust the axial position of the muzzle attachment 20. As will be described in more detail below, the locking ring 15 allows for a user to lock a position of the muzzle attachment 20 which has, after testing, resulted in the optimum tuning of the firearm. Once the locking ring 15 has been fixed in position, a user may remove the muzzle attachment 20 in order to reduce the length of the firearm or to clean the muzzle attachment 20 and then later reattach that muzzle attachment 20 to the firearm at the same axial position to return to the optimum tuning position.

The assembly operation of the system and tuning of the firearm will now be described with reference to FIG. 1. A user would select an attachment device 10 that fits the thread size of their firearm barrel 30. Then, the user would partially connect the second connector 17 to the barrel 30. In this partially connected state, the user would rotate the annular body 11 of the attachment device 10 by aligning the first connector 12 (shown in FIG. 1 as a channel) to a predetermined orientation, for example vertically upwards, in order to time the attachment device 10 to the barrel. The user would then fully tighten the second connector 17 to the barrel 30 with the first connector 12 orientated in this predetermined orientation.

After fully tightening the second connector 17 to the barrel 30, the user may then attach the muzzle attachment 20 to the first connector 12, for example by sliding the muzzle attachment 20 on to the first connector so as to slidingly engage the muzzle connector 21 with the first connector 12. The user may then wish to tune the firearm.

During the tuning process, the user may fix the locking ring 15 in position so that it abuts up against the back plate 22 of the muzzle attachment 20 in a certain axial position. The user then fires a grouping of shots. The user then releases the locking ring 15 and uses the adjustment mechanism 23 to move the axial position of the muzzle attachment 20 either forwards or backwards along the central axis 105, and then fires another grouping of shots. Due to the different axial position of the muzzle attachment 20, the harmonics of the barrel 30 has changed, and the grouping accuracy of the firearm will be different as compared to the grouping accuracy of the firearm with the original axial position of the muzzle attachment 20. The user can then continue to move the muzzle attachment 20 axially forwards and backwards to tune the barrel 30 until the grouping accuracy of the user's shots is satisfactory. Once the user is satisfied with the grouping accuracy of their shots, the firearm is then considered to be tuned. In other words, the barrel vibration of the firearm is such that, with the specific axial position of the muzzle attachment 20 with respect to the firearm barrel, the grouping of the user's shots is reduced.

It is important to note that the tuning process disclosed herein is performed by axially adjusting the mass of the muzzle attachment 20 itself along the central axis 105 instead of using a separate barrel tuner mass in addition to a muzzle attachment. In this manner, the overall weight of the firearm can be reduced as compared to a hypothetical configuration in which both a barrel tuner and a muzzle attachment are incorporated onto a firearm. Additionally, with the above-described system, the user's line of sight along the barrel of the firearm may be improved as compared to the use of certain types of bulky barrel tuners.

If the user then wishes to remove the muzzle attachment 20 for cleaning or another purpose, the user may use the adjustment mechanism 23 to urge the muzzle attachment 20 forward without releasing the locking ring 15 until the muzzle connector 21 is detached from the first connector 12. Then, when the user wishes to reconnect the muzzle attachment 20 to the barrel 30, the user is able to re-connect the muzzle connector 21 to the first connector 12 and adjust the position of the muzzle attachment 20 axially backwards until the rear plate 22 of the muzzle attachment abuts against the fixed locking ring. The firearm is then brought back to the tuned state.

Figure 3:
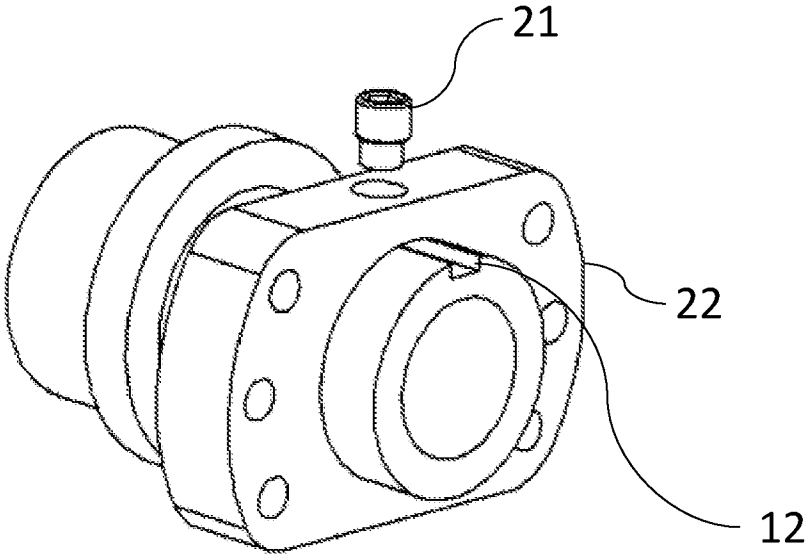
FIG. 3 shows an embodiment of the attachment device.

FIG. 3 shows a closer view of the rear plate 22 with the muzzle connector 21 being positioned around the first connector 12. As can be seen from FIG. 3, the rear plate 22 can be axially adjusted over the length of the first connector 12 to thereby axially adjust the position of the muzzle attachment with respect to the firearm barrel.

Figure 4:
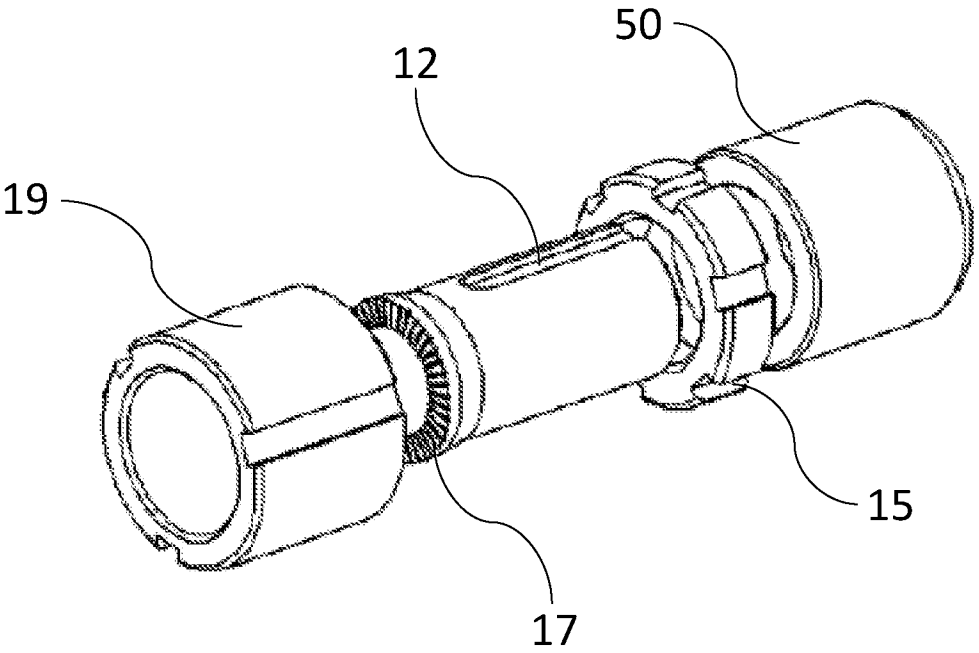
FIG. 4 shows an attachment device and muzzle attachment in accordance with a second embodiment of the invention.

FIG. 4 shows another embodiment of the attachment device. In the attachment device 200 of FIG. 4, an overnut is used as the linking nut 18 to connect the second connector 17 to the barrel 30. The attachment device 200 also includes a locking ring 15 and a first connector 12. The overnut arrangement is simpler to produce as compared to the use of a jam nut as a linking nut 18, as shown in FIG. 1, but may leave visible exposed threads. As such, a thread protector 50 is preferably included to reduce the ingress of dirt into these threads.

It is also noted that existing muzzle attachments may be retrofitted so as to be used with the attachment device 10. In particular, most muzzle attachments include some form of rear plate or other part to connect the muzzle attachment to the barrel. It is possible to replace this part, such as fitting a replacement rear plate, of an existing muzzle attachment with a rear plate which includes a muzzle connector 21 which is configured to connect to the first connector 12 in order to achieve the advantages associated with the above-described system with an existing muzzle attachment.

The above described system also allows for users to adapt their retrofitted existing muzzle attachment to work across multiple firearms, since the retrofitted muzzle attachment will be able to mate with the first connector 12 of any attachment device 10, even if the thread size of the second connector 17 of the attachment device 10 differs due to the need to mate with certain thread sizes on the barrel 30 of the firearm. This means that if a user does have multiple firearms with barrels that have different thread sizes then they can fit each weapon with a corresponding attachment device 10 having a second connector 17 with a matching thread size for that weapon, and the muzzle attachment 20 will be usable with each one of these attachment devices. This means that the user only has to buy a multiple of less expensive attachment devices and a single, more costly, muzzle attachment as compared to buying multiple muzzle attachments.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. An attachment device for use with a firearm barrel, the attachment device having a central axis and comprising:

an annular body extending around the central axis and having a first end, a second end opposite to the first end and an external surface, wherein the annular body comprises a first connector located proximate to the first end of the annular body, the first connector for connecting to a muzzle attachment, wherein the first connector allows for axial movement of the muzzle attachment parallel to the central axis but prevents rotational movement of the muzzle attachment about the central axis; and a second connector located proximate to the second end of the annular body, the second connector for connecting the attachment device to the firearm barrel.

2. The attachment device of claim 1, wherein the attachment device is both partially and fully connectable to the firearm barrel, wherein the attachment device is rotatable about the central axis when the attachment device is partially connected to the firearm barrel, and wherein a position of the first connector allow for visual timing of the attachment device with respect to the firearm barrel.

3. The attachment device of claim 1, wherein the first connector comprises a channel formed in the external surface of the annular body, the channel extending from the first end of the annular body.

4. The attachment device of claim 1, wherein the attachment device further comprises an adjustment screw thread disposed about the first connector.

5. The attachment device of claim 1, wherein the second connector comprises a connecting screw thread.

6. The attachment device of claim 5, further comprising a linking nut comprising threads, the linking nut configured to thread onto the connecting screw thread of the second connector and onto a screw thread of the firearm barrel to thereby connect the attachment device to the firearm barrel.

7. The attachment device of claim 6, wherein the linking nut is configured to not extend beyond the screw thread of the firearm barrel and over an exterior surface of the firearm barrel.

8. A system comprising:

a muzzle attachment comprising a muzzle connector; and an attachment device for use with a firearm barrel, the attachment device having a central axis and comprising:

an annular body extending around the central axis and having a first end, a second end opposite to the first end and an external surface, wherein the annular body comprises a first connector located proximate to the first end, the first connector for connecting the muzzle connector of the muzzle attachment to the attachment device, wherein the first connector allows for axial movement of the muzzle attachment parallel to the central axis but prevents rotational movement of the muzzle attachment about the central axis; and a second connector located proximate to the second end of the annular body, the second connector for connecting the attachment device to the firearm barrel.

9. The system of claim 8, wherein the first connector of the annular body comprises a channel formed in the external surface of the annular body, the channel extending from the first end of the annular body, wherein the muzzle connector comprises a protrusion configured to slidingly engage with the channel so as to allow the axial movement of the muzzle attachment parallel to the central axis and to prevent the rotational movement of the muzzle attachment about the central axis.

10. The system of claim 8, wherein the muzzle attachment includes an adjustment mechanism, the adjustment mechanism comprising an adjustment wheel having an internal screw thread, wherein the attachment device includes an adjustment screw thread disposed about the first connector and configured to engage with the internal screw thread of the adjustment wheel, and wherein rotation of the adjustment wheel is configured to urge the muzzle attachment axially along the central axis.

11. The system of claim 8, wherein the attachment device further comprises a locking ring, the locking ring being releasingly engagable with the muzzle attachment and configured to, when engaged, prevent the axial movement of the muzzle attachment along the central axis in a direction toward the second end of the annular body of the attachment device.

12. The system of claim 11, wherein the locking ring further comprises a clamp configured to fix a position of the locking ring with respect to the annular body, wherein, optionally, the clamp comprises a grub screw.

13. A method of attaching the muzzle attachment to the firearm barrel using the attachment device of claim 1, the method comprising:

partially connecting the attachment device to the firearm barrel using the second connector;

rotating the attachment device about the central axis so that the first connector is positioned in a predetermined position so as to time the attachment device with respect to the firearm barrel;

fully connecting the attachment device to the firearm barrel using the second connector; and connecting the muzzle attachment to the attachment device using the first connector.

14. The method of claim 13, further comprising adjusting an axial position of the muzzle attachment along the annular body during barrel tuning of the firearm barrel.

15. A method of retrofitting the muzzle attachment so as to be compatible with the attachment device of claim 1, the method comprising removing a part of the muzzle attachment and replacing the part with a replacement part that includes a muzzle connector that is configured to connect with the first connector of the attachment device.

16. A firearm comprising:

an attachment device for use with a firearm barrel, the attachment device having a central axis and comprising:

an annular body extending around the central axis and having a first end, a second end opposite to the first end and an external surface, wherein the annular body comprises a first connector located proximate to the first end, the first connector for connecting the muzzle connector of the muzzle attachment to the attachment device, wherein the first connector allows for axial movement of the muzzle attachment parallel to the central axis but prevents rotational movement of the muzzle attachment about the central axis; and a second connector located proximate to the second end of the annular body, the second connector for connecting the attachment device to the firearm barrel.

17. The firearm of claim 16, further comprising the muzzle attachment, wherein the muzzle attachment includes a muzzle connector configured to connect the muzzle attachment to the first connector of the annular body.

* * * * *